US006561180B1

(12) United States Patent
Austin et al.

(10) Patent No.: US 6,561,180 B1
(45) Date of Patent: May 13, 2003

(54) OVEN DOOR ASSEMBLY

(75) Inventors: Kerry O. Austin, Ocoee, TN (US); Paul Kelly, Aiken, SC (US); Jimmy C. Roden, Chattanooga, TN (US); Liana Webb, Ooltewah, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/045,081

(22) Filed: Jan. 15, 2002

(51) Int. Cl.[7] ..... F24C 15/04
(52) U.S. Cl. ..... 126/198; 126/190
(58) Field of Search ..... 126/198, 190

(56) References Cited

U.S. PATENT DOCUMENTS

| | | | | |
|---|---|---|---|---|
| 2,580,957 A | | 1/1952 | Reeves | |
| 2,612,154 A | | 9/1952 | Mills | |
| 3,577,973 A | | 5/1971 | Katona | |
| 3,778,175 A | | 12/1973 | Zimmer | |
| 3,855,994 A | | 12/1974 | Evans et al. | |
| 3,877,460 A | | 4/1975 | Lotz et al. | |
| 3,936,107 A | | 2/1976 | Gourdeau et al. | |
| 4,041,930 A | | 8/1977 | Katona | |
| 4,043,091 A | | 8/1977 | Katona | |
| 4,060,069 A | | 11/1977 | Drouin | |
| 4,102,322 A | * | 7/1978 | Doner | 126/198 |
| 4,253,286 A | | 3/1981 | Katona | |
| 4,479,737 A | | 10/1984 | Bergh et al. | |
| 4,606,324 A | | 8/1986 | Katona | |
| 5,029,571 A | | 7/1991 | Trosin | |
| 5,048,233 A | * | 9/1991 | Gidseg et al. | 49/501 |
| 5,799,647 A | | 9/1998 | Mills | |
| 5,819,722 A | | 10/1998 | Katz | |
| 5,881,710 A | | 3/1999 | Davis et al. | |
| 5,928,540 A | * | 7/1999 | Antoine et al. | 219/391 |

* cited by examiner

*Primary Examiner*—Henry Bennett
*Assistant Examiner*—Alfred Basichas
(74) *Attorney, Agent, or Firm*—Diederiks & Whitelaw, PLC

(57) ABSTRACT

An oven door assembly having a minimum number of required components parts is constructed by attaching a pair of spaced hinge assemblies, preferably through a tab and slot arrangement to the first panel, and positioning a central window pack on a first panel. A second panel is then snap-fit directly through the hinge assemblies to the first panel, thereby indirectly securing the second panel to the first panel through the hinge assemblies with the window pack therebetween.

19 Claims, 8 Drawing Sheets

OVEN DOOR ASSEMBLY

BACKGROUND OF INVENTION

1. Field of Invention

The present invention pertains to the art of cooking appliances and, more particularly, the construction and assembly of an oven door which includes components that are snap-fit together in order to simplify assembly and reduce production costs.

2. Discussion of Prior Art

Ovens and their general construction are well known. In general, an oven includes a cooking cavity having an opening which is selectively closed by a door assembly. Usually, ovens are of two general configurations, the ovens are either built-in units, i.e. into a cabinet or wall, or the oven is a free standing range including a cooktop. The doors furnished with ovens can be composed of multiple components which can include a sealing panel, thermal insulation, a window, an intermediate panel, an outer panel, handles, hinges and, in some instances, a decorative face covering. In order to join all of the aforementioned components into a door, a large number of fasteners or welds are typically required.

A major disadvantage of this known arrangement is the number of assembly operations and fasteners required to construct the oven door. The relatively large number of parts, and complexity of construction increases manufacturing costs. As the home appliance industry is highly competitive, reducing the number of component parts and simplifying construction could lead to a tremendous cost and efficiency savings. However, the overall assembly must still be structurally sound and reliable. Although attempts have been made to simplify the overall construction of an oven door, there exists a need in the art for an improved oven door construction assembly.

SUMMARY OF THE INVENTION

An oven door constructed in accordance with the present invention overcomes the disadvantages in the art by reducing the number of components and simplifying the overall construction of an oven door. Specifically, the oven door of the present invention includes a first panel adapted to seal the oven cavity of a cooking appliance, a hinge assembly secured to the first panel, at least one internal door component positioned against the first panel, and a second panel which is snap-fit to the hinge assembly securing the internal door component in position.

Preferably, the hinge assembly is secured to the first panel by first positioning a tab located on a first end of the hinge assembly in a slot provided on an edge portion of the first panel. The hinge assembly is then rotated so as to be positioned against the first panel. Once the hinge assembly is in place, the internal door component(s) is installed in at central portion of first panel. In the most preferred embodiment of the invention, a pre-assembled internal component taking the form of a window pack is utilized. More specifically, the window pack includes an interlocking frame assembly which utilizes matching L-shaped frame elements designed to secure two glass panes in a spaced relationship. Each of the L-shaped frame elements includes a tab and slot structure designed to snap-fit the frame elements into a substantially rectangular support for the glass panes. Once the internal door components are in position, a second panel is snap-fit to the hinge assembly thereby securing the window pack between the first and second panels.

Based on the above, it should be readily apparent that the invention provides for an oven door assembly having a minimum number of required component parts and employs constructions steps which simplifies the construction process and leads to an overall cost savings for the manufacturer. In any event, additional objects, features and advantages of the invention will become more readily apparent from the following detailed description of a preferred embodiment of the invention, when taken in conjunction with the drawings wherein like reference numerals refer to corresponding parts in the several views.

DETAILED DESCRIPTION OF THE INVENTION

Figure 1:
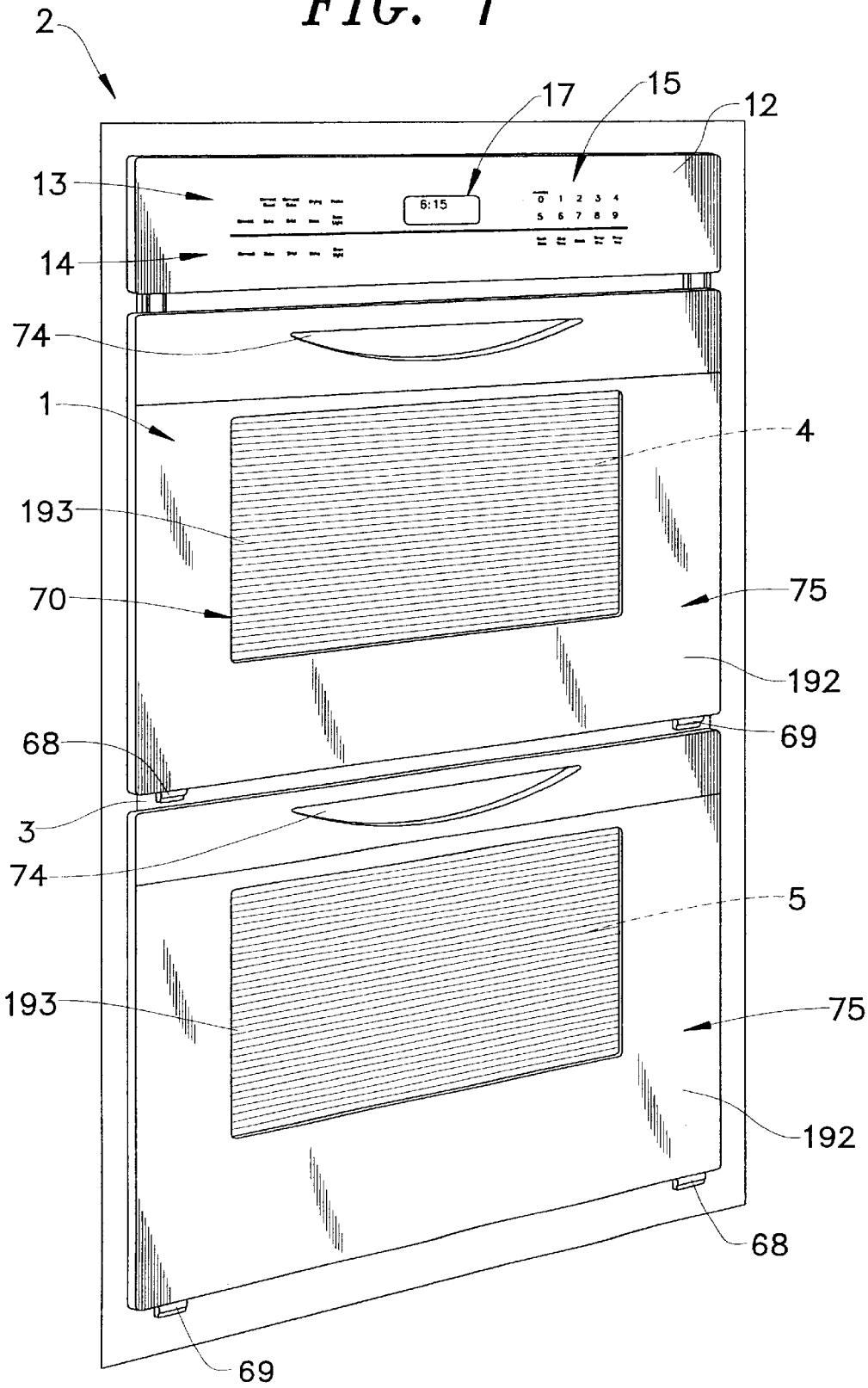
FIG. 1 is a perspective view of a wall oven including multiple oven cavities having associated, identical door assemblies constructed in accordance with the present invention.

With initial reference to FIG. 1, an oven door assembly constructed in accordance with the present invention is generally shown at 1. Although the actual cooking appliance to which door assembly 1 can be applied can vary, the invention is shown in connection with a cooking appliance 2 depicted as a wall oven. In the embodiment shown, cooking appliance 2 constitutes a dual oven wall unit which includes identically constructed upper and lower oven door assemblies 1. Cooking appliance 2 further includes a structural frame 3 supporting an upper cooking cavity 4 and a lower cooking cavity 5. According to the present invention, an associated door assembly 1 is provided to selectively provide access to a respective one of upper and lower cooking cavities 4 and 5. Although cooking appliance 2 is depicted as a wall oven, it should be understood that door assembly 1 is not limited to this model type and can be incorporated into various types of oven configurations, e.g., cabinet mounted ovens and ranges.

Cooking appliance 2 is shown to incorporate an upper control panel 12. In the embodiment shown, control panel 12 includes first and second rows of oven control buttons 13 and 14 for programming, in combination with a numeric pad 15 and a display 17, particular cooking operations for oven cavities 4 and 5 respectively. Since the general programming and operation of cooking appliance 2 is known in the art and does not form part of the present invention, these features will not be discussed further here.

Figure 2:
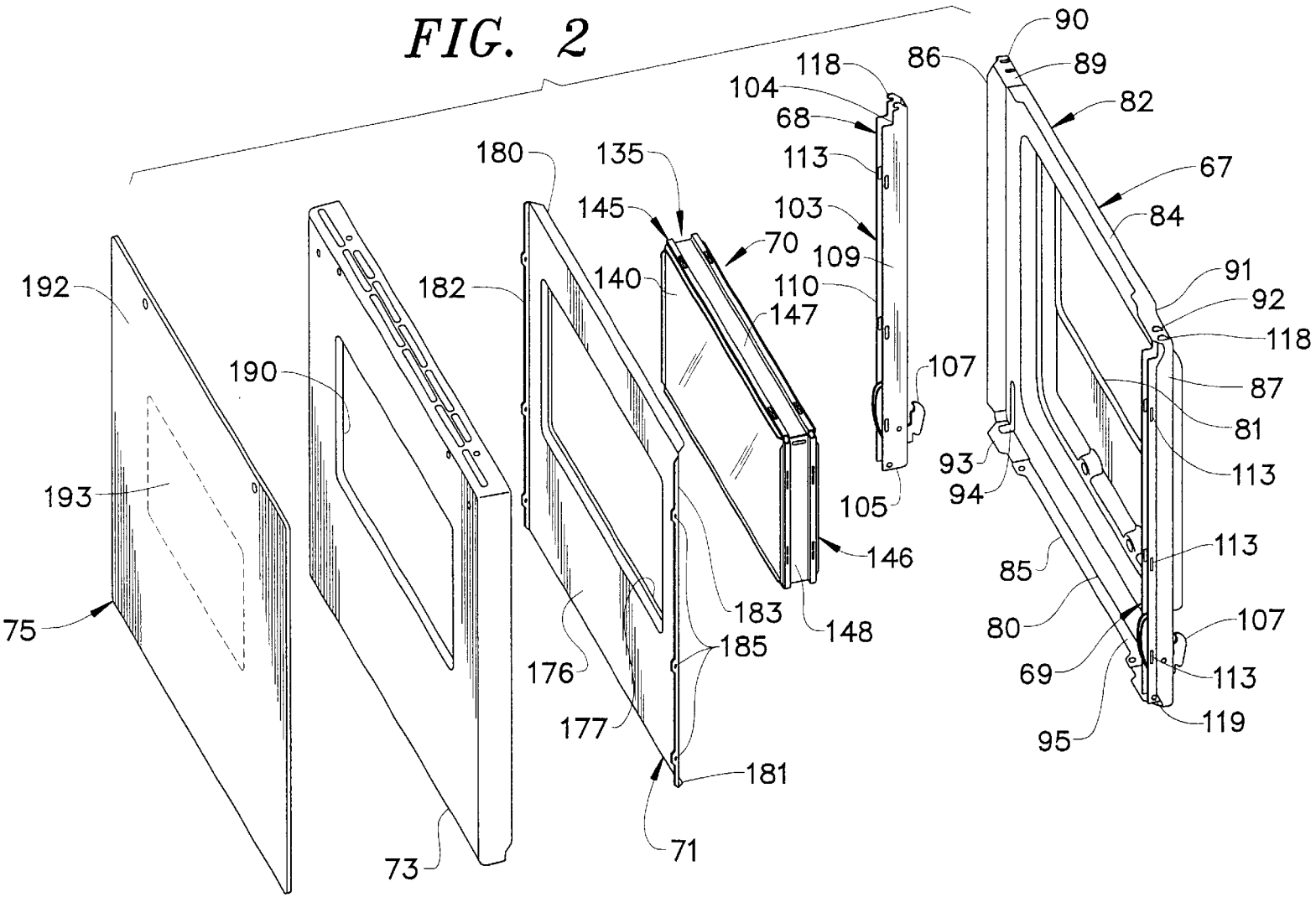
FIG. 2 is an exploded view of the door assembly shown in FIG. 1.
Figure 3:
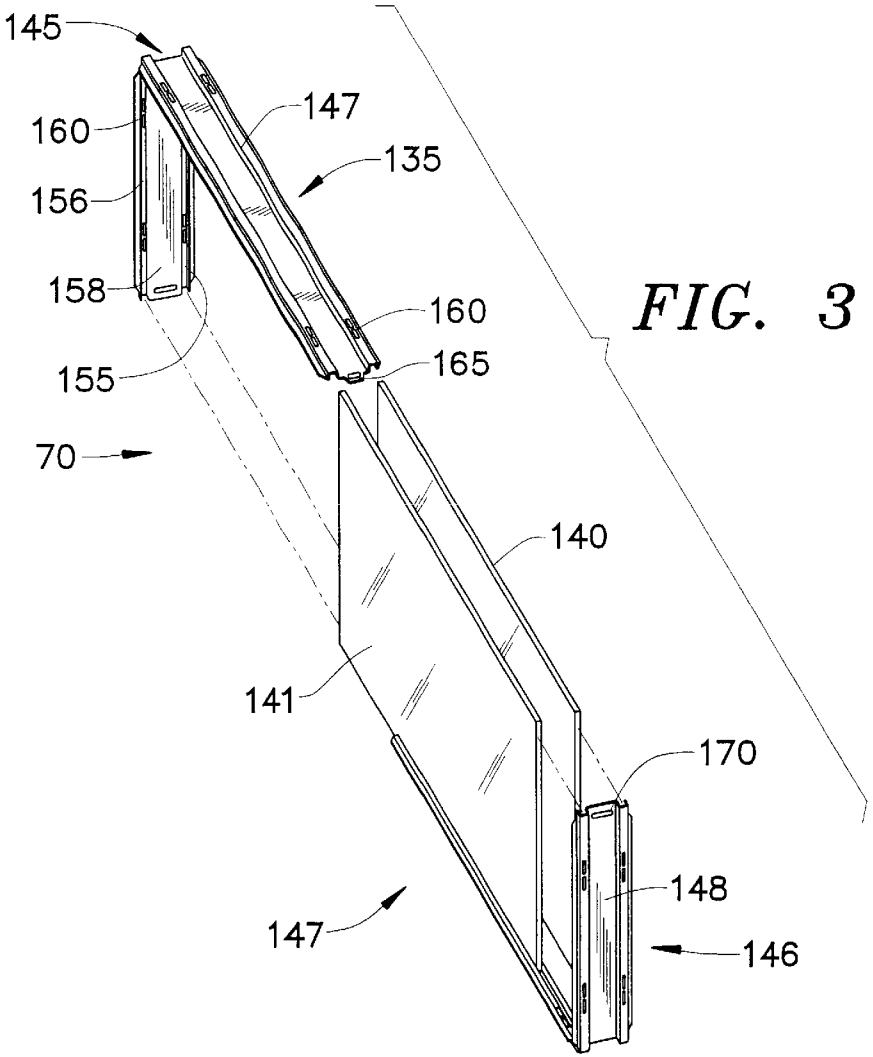
FIG. 3 is an exploded view of a window pack incorporated in the door assembly of FIG. 2.
Figure 4:
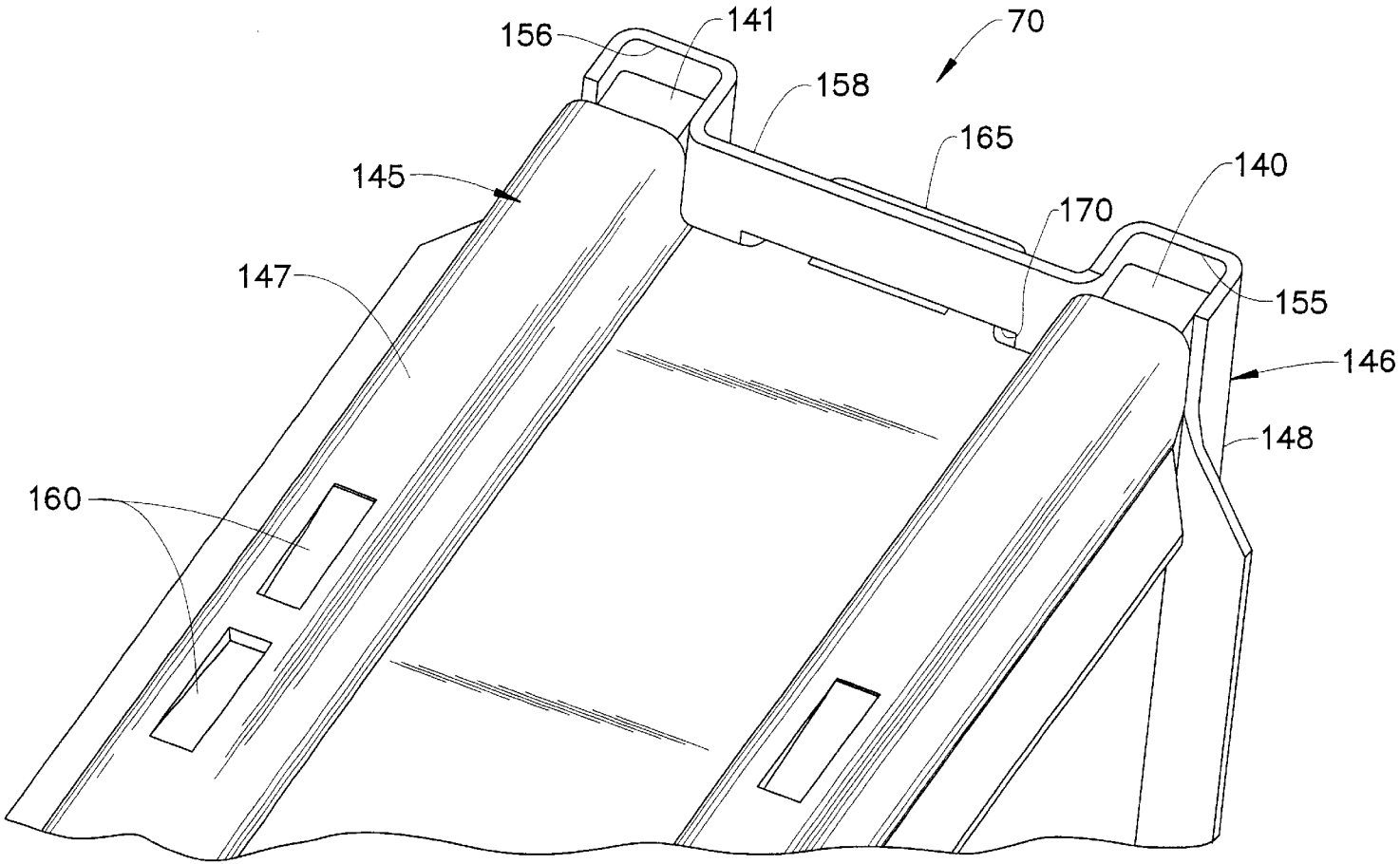
FIG. 4 is an enlarged view of a portion of the window pack of FIG. 3.
Figure 5:
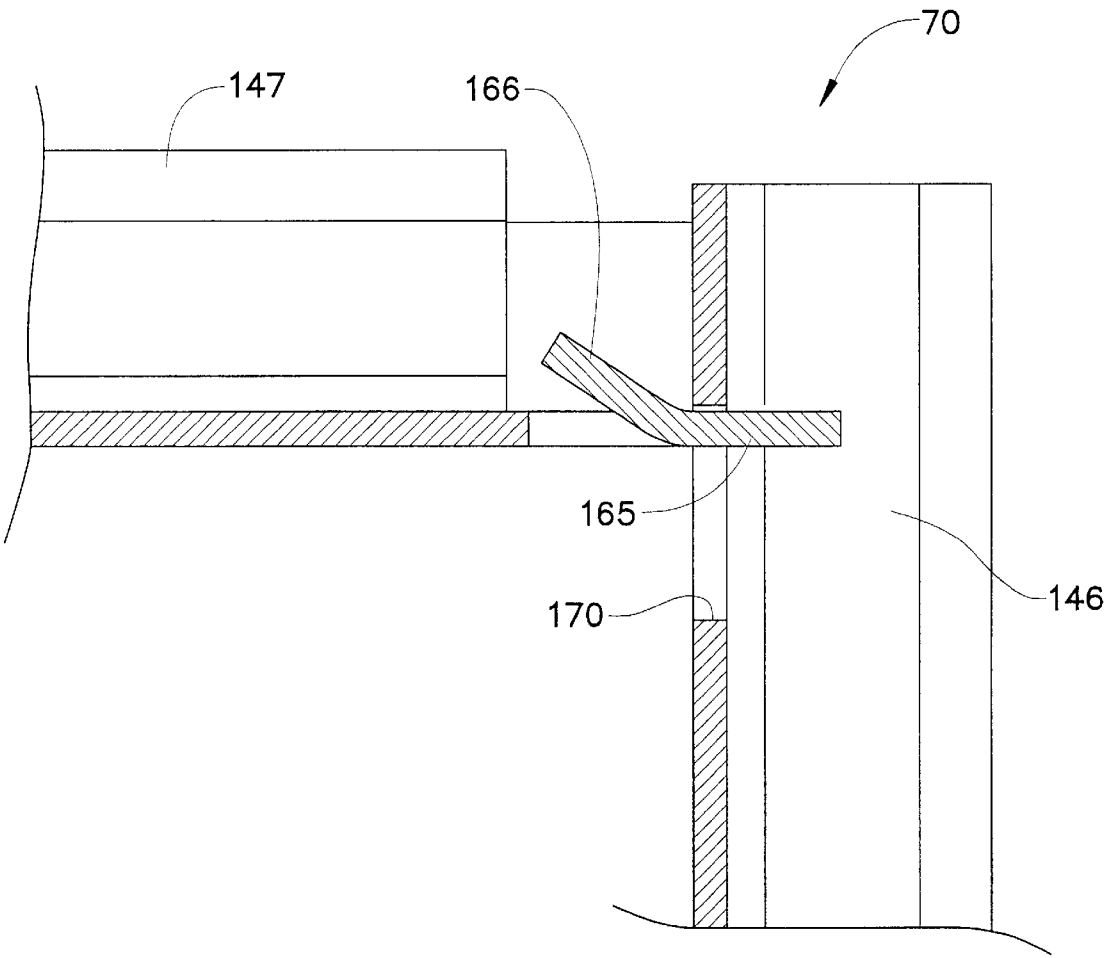
FIG. 5 is an enlarged, cross-sectional side view of a frame connection utilized in the window pack of FIGS. 3 and 4.
Figure 6:
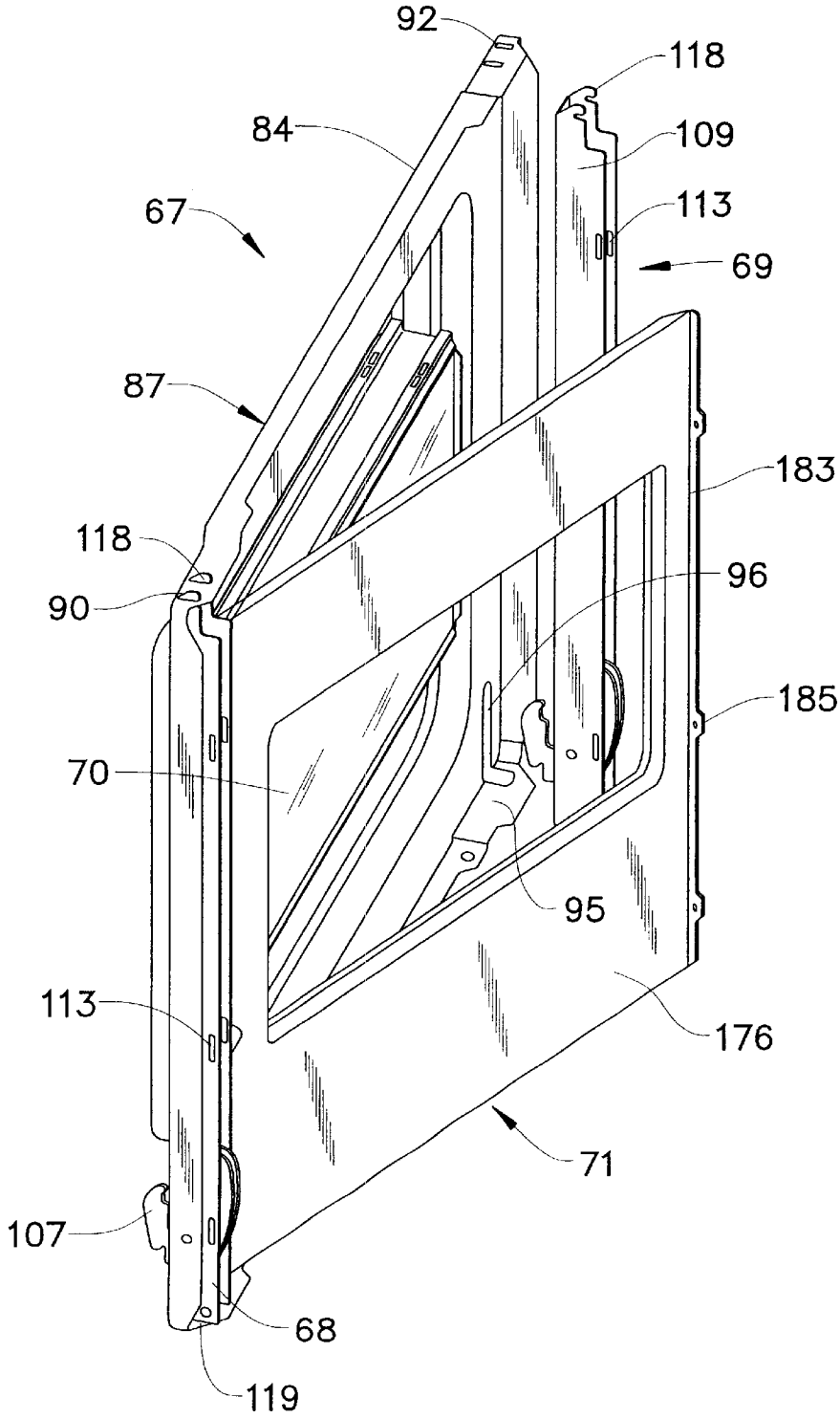
FIG. 6 is a perspective, partly assembled view of the door assembly of the invention.

FIG. 2 is an exploded view of door assembly 1 according to the preferred embodiment and illustrates the various internal components of door assembly 1. The major internal components are: a first panel 67, hinge assemblies 68 and 69, a window pack 70, a second panel 71, and an outer panel 73. Outer panel 73 has associated therewith a handle 74 (see FIG. 1) and a decorative cover 75 to complete the assembly. The construction and interconnection of these components will now be described in detail.

First panel 67 is preferably, substantially rectangular and includes a multi-level base portion 80, a window opening 81, and a peripheral edge portion 82. More specifically, peripheral edge portion 82 is defined by a top portion 84, a bottom portion 85, a left side portion 86 and a right side portion 87. Top portion 84 includes a first end 89 having a pair of adjacent slots 90 and a second end 91 having matching slots 92. Bottom portion 85 includes a first end 93 having a slotted opening 94 having both vertical and horizontal components and a second end 95 having a matching opening 96 which also extends in two, substantially perpendicular planes. Slots 90 and 92, as well as openings 94 and 96, are provided in connection with the mounting of the hinge assemblies 68 and 69 to the first panel 67 as will be detailed more fully below.

Figure 7:
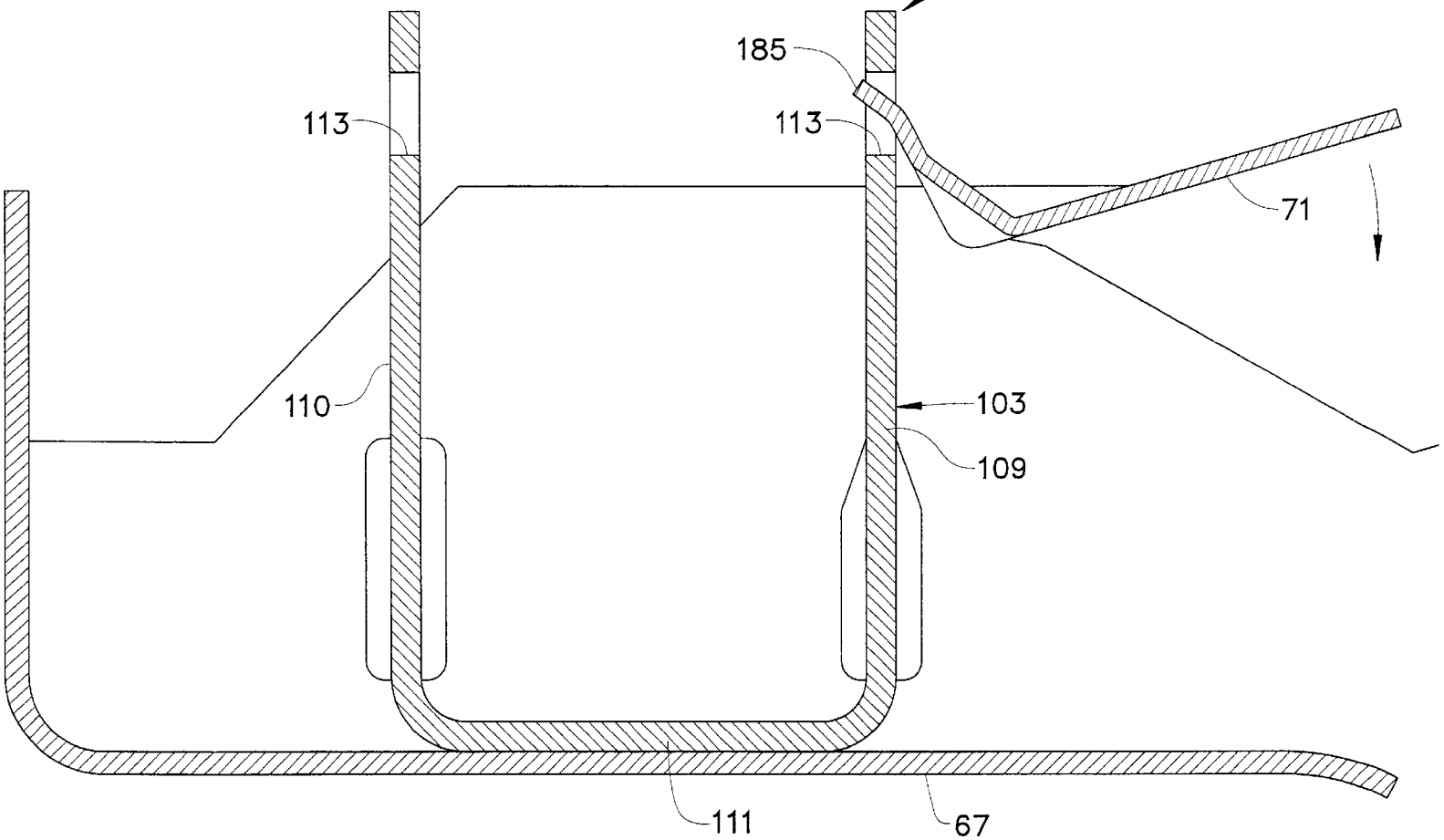
FIG. 7 is a cross-sectional view of a snap-fit connection portion of the door assembly of the invention in an initial connection stage.
Figure 8:
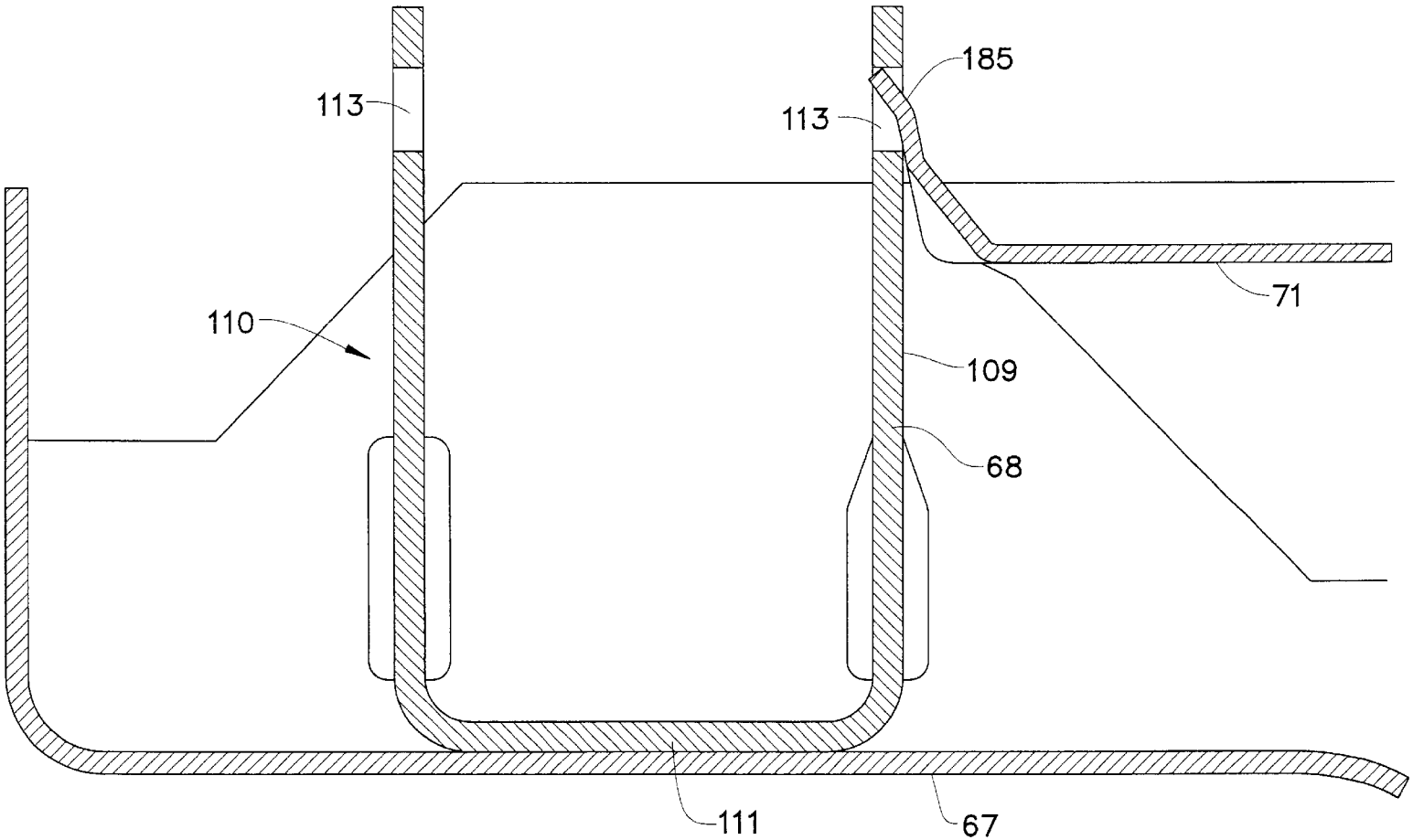
FIG. 8 is a cross-sectional view similar to that of FIG. 7, but depicting the snap-fit connection in a final connection stage.

Hinge assemblies 68 and 69 are substantially identically constructed and therefore a detailed description will now be provided in connection with the construction of hinge assembly 68 and it is to be understood that hinge assembly 69 is correspondingly constructed. Hinge assembly 68 is constituted by a hinge bar 103 having a first end 104 and a second end 105. A pivoting hinge arm 107 projects forward from second end 105 of hinge bar 103. Hinge arm 107 is adapted to extend through opening 94 and to be interconnected with the frame 3 of cooking appliance 2 to pivotally mount door assembly 1 across a respective oven cavity 4, 5. In the most preferred embodiment, hinge bar 103 is constituted by an elongated U-shaped channel member including opposing side portions 109 and 110 joined through a web 111 (also see FIGS. 7 and 8). Each of side portions 109 and 110 includes a plurality of snap elements 113, such as holes, arranged at spaced locations between first end 104 and second end 105. In addition, first end 104 including at least one tab element 118 and, preferably, a pair of adjacent tab elements 118.

Reference will now be made to FIGS. 2–5 in describing the preferred construction of window pack 70 of door assembly 1. In a manner known in the art, window pack 70 is provided to enable a consumer to view the contents of a particular cooking cavity 4, 5. As shown, window pack 70 includes a substantially rectangular metal frame 135 and opposing panes of glass 140 and 141. In a preferred embodiment, frame 135 includes substantially identical L-shaped frame elements 145 and 146. Each L-shaped frame element 145, 146 includes a long leg portion 147 and a short leg portion 148. Additionally, each frame element 145, 146 includes a pair of generally U-shaped tracks 155 and 156 joined by a web 158. Tracks 155 and 156 are adapted to receive and maintain glass panes 140 and 141 in a spaced relationship. A plurality of glass retainer elements 160 are stamped into tracks 155 and 156 to support each glass pane 140, 141 within a respective track 155, 156. Glass retainer elements 160 are simply defined by bent, preferably metal tab portions of tracks 155 and 156 which function to bias glass panes 140 and 141 in order to substantially reduce the effects of vibration caused by operation of door assembly 1. To aid assembly, a tab element 165 having a spring retaining portion 166 is provided at the terminal end of each long leg portion 147 and a matching slot 170 is provided at the terminal end of each short leg portion 148.

During assembly of window pack 70, each of glass panes 140 and 141 are inserted into a respective one of tracks 155 and 156 of an L-shaped frame element 145, 146 such that glass panes 140 and 141 rest against respective retainer elements 160. The opposing L-shaped frame elements 145 and 146 are positioned such that one short leg portion 148 is arranged adjacent to a corresponding long leg portion 147. Once positioned in this manner, each of tab elements 165 is interengaged with an associated slot 170. In this manner, frame elements 145 and 146 are snap-fittingly interconnected to form window pack 70.

Referring mainly to FIG. 2, second panel 71 is preferably, substantially rectangular in shape and includes a base portion 176 having a window opening 177. Base portion 176 is preferably formed with an in-turned top lip 180, an in-turned bottom lip 181, an out-turned right side lip 182 and an out-turned left side lip 183. As shown, each of right and left side lips 182 and 183 includes a plurality of snap members 185 arranged at spaced locations there along. In the preferred embodiment shown, snap members 185 are constituted by dimpled, resilient tab portions of right and left side lips 182 and 183.

Outer panel 73 is preferably formed of metal and defines a substantially rectangular member including a window opening 190. As will be discussed more fully below, outer panel 73 is adapted to encompass first and second panels 67 and 71, with hinge assemblies 68 and 69 and window pack 70 sandwiched therebetween. Decorative panel 75 is optionally provided and preferably constitutes a glass panel having a substantially opaque outer area 192 and a substantially clear inner window area 193. Although decorative panel 75 is preferably made of glass, various other materials could be employed for decoratively covering the outer surface of outer panel 73. However, no decorative panel 75 need be provided.

Reference will now be made to FIGS. 2 and 6–8 in describing the preferred manner in which door assembly 1 is assembled. Initially, hinge assemblies 68 and 69 are secured to first panel 67 by positioning tab elements 118 within respective slots 90 and 92 on first panel 67. Hinge assemblies 68 and 69 are then rotated into contact with first panel 67 until hinge arms 107 project through openings 96. Next, pre-assembled window pack 70, constructed as previously described, is positioned onto first panel 67 between hinge assemblies 68 and 69 such that window panes 140 and 141 are exposed in opening 81. A gasket (not shown) may be provided as a seal between the perimeter of window pack 70 and opening 81. In addition to window pack 70, thermal insulation (not shown) of a type well known in the art is also be preferably incorporated into door assembly 1 to reduce any heat transfer from a respective oven cavity 4, 5 to the exterior.

After window pack 70 is positioned on first panel 67, second panel 71 is secured to first panel 67 through hinge assemblies 68 and 69. More specifically, snap members 185 on the left panel edge 182 are engaged with associated snap elements 113 on hinge assembly 68. Second panel 71 is subsequently rotated into contact with hinge assembly 69, wherein the snap members 185 of right panel edge 183 are snap-fit to the associated snap elements 113 on hinge assembly 69, wherein window pack 70 is secured therebetween.

Referring to FIG. 2, after second panel 71 is secured to first panel 67 through hinge members 68 and 69, outer panel 73 is secured to first panel 67 and second panel 71. In general, outer panel 73 and decorative panel 75 simply complete the overall oven door assembly 1, with outer panel 73 actually extending around and being attached, preferably through the use of screws (not shown) to first panel 67. Outer panel 73 is preferably a metal panel having a substantially rectangular area including a window opening 190 which is aligned with opening 177. Decorative panel 75 is preferably a glass panel having a substantially opaque outer area 192 and a substantially clear inner window area 193. Although decorative panel 75 is illustrated as glass, any suitable material for covering the outer surface of outer panel 73 would be acceptable, particularly since panel 75 is for decorative purposes and is an optional part for oven door assembly 1. Finally, handle 74 is secured to door assembly 1 completing the construction.

Based on the above, it should be readily apparent that the invention provides for an oven door assembly having relatively few component parts which are assembled in a simplified construction process, leading to a significant cost savings. In any event, it should be understood that various changes and/or modifications can be made to the invention without departing from the spirit thereof Additionally, it should be recognized that the use of terms such as top, bottom, left and right have been presented for illustrative purposes only and should not limit the scope of the present invention. Instead, the invention is only intended to be limited by the scope of the following claims.

We claim:

1. In a cooking appliance including an oven cavity having an associated access opening, a door assembly provided to selectively seal the opening, said door assembly comprising:

a substantially rectangular first panel;

at least one hinge assembly attached to the first panel, said hinge assembly including a side portion provided with a plurality of snap elements;

a window pack including at least one glass pane for viewing the oven cavity through the door assembly; and a second panel including at least one edge portion provided with a plurality of snap members which are engaged with the snap elements of the at least one hinge assembly, wherein the second panel interconnected to the first panel through the hinge assembly with the window pack therebetween.

2. The door assembly as claimed in claim 1, wherein the first panel includes at least one slot for attaching the hinge assembly thereto.

3. The door assembly as claimed in claim 2, wherein the hinge assembly includes at least one tab element positioned in the at least one slot.

4. The door assembly as claimed in claim 3, wherein the at least one hinge assembly includes a pair of spaced hinge members, which each hinge member having a pivoting hinge arm at an end opposite the at least one tab element.

5. The door assembly as claimed in claim 4, wherein the first panel is formed with a pair of spaced, slotted openings, each said pivoting hinge arm projecting through a respective one of the pair of slotted openings.

6. The door assembly as claimed in claim 5, wherein each of the slotted openings extends in two, substantially perpendicular planes.

7. The door assembly as claimed in claim 1, wherein each of the snap elements constitutes an opening formed in the at least one hinge assembly and each of the plurality of snap elements constitutes a flexible tab.

8. The door assembly as claimed in claim 7, wherein the resilient tab is dimpled.

9. The door assembly as claimed in claim 1, wherein the window pack includes a first glass pane, a second glass pane and a frame structure, said frame structure including at least two interlocked frame elements extending about portions of each of the first and second glass panes and maintaining the first and second glass panes in a spaced relationship.

10. The door assembly as claimed in claim 9, wherein the frame structure included two generally L-shaped members.

11. The door assembly as claimed in claim 10, wherein the generally L-shaped members includes means for snap-fitting the L-shaped members together.

12. The door assembly as claimed in claim 1, further comprising: a substantially rectangular outer panel including a window opening, said outer panel extending about a portion of and being secured to the first panel, with the second panel arranged therebetween and the window pack being aligned with the window opening.

13. The door assembly as claimed in claim 12, further comprising: a decorative panel attached to the outer panel.

14. A method of assembling an oven door comprising:

attaching at least one hinge assembly to a first panel of the oven door;

positioning at least one internal door component against the first panel; and snap-fittingly attaching a second panel directly to the hinge assembly such that the first panel is coupled to the second panel through the hinge assembly while securely retaining the at least one internal door component therebetween.

15. The method as claimed in claim 14, wherein the at least one internal door component constitutes a window pack.

16. The method as claimed in claim 15, further comprising: creating the window pack by: positioning first and second glass panes within tracks formed in a first frame element; and interlocking a second frame element to the first frame element, with the first and second frame elements extending about portions of each of the first and second glass panes, while maintaining the first and second glass panes in a spaced relationship.

17. The method as claimed in claim 16, further comprising: interlocking the first and second frame elements solely through a snap-fit connection.

18. The method as claimed in claim 14, further comprising: securing an outer panel about portions of the first panel, with the second panel and the at least one internal component therebetween.

19. The method as claimed in claim 18, further comprising: securing a decorative panel to the outer panel.

* * * * *